US012773599B2

(12) United States Patent
Chen

(10) Patent No.: US 12,773,599 B2
(45) Date of Patent: Oct. 27, 2026

(54) PAD STRUCTURE

(71) Applicant: Wei-Jung Chen, Taipei City (TW)

(72) Inventor: Wei-Jung Chen, Taipei City (TW)

( * ) Notice: Subject to any disclaimer, the term of this patent is extended or adjusted under 35 U.S.C. 154(b) by 1038 days.

(21) Appl. No.: 17/935,428

(22) Filed: Sep. 26, 2022

(65) Prior Publication Data

US 2023/0099809 A1 Mar. 30, 2023

(30) Foreign Application Priority Data

Sep. 28, 2021 (TW) ..... 110136069

(51) Int. Cl.
*A63B 49/14* (2015.01)

(52) U.S. Cl.
CPC ..... *A63B 49/14* (2013.01)

(58) Field of Classification Search
CPC ... A63B 49/022; A63B 49/025; A63B 49/028; A63B 49/14; A63B 51/12
USPC ..... 473/524, 532, 533, 534, 539, 540, 541, 473/542, 543, 548
See application file for complete search history.

(56) References Cited

U.S. PATENT DOCUMENTS 1,523,865 A * 1/1925 Craig ..... A63B 49/022 473/542
1,621,746 A * 3/1927 Morten ..... A63B 51/12 473/534
3,884,467 A * 5/1975 Sommer ..... A63B 49/022 473/539
4,340,225 A * 7/1982 Wilson ..... A63B 51/12 473/534
4,591,165 A * 5/1986 Sines ..... A63B 60/00 473/540
4,681,319 A * 7/1987 Zilinskas ..... A63B 49/022 273/DIG. 23
4,930,782 A * 6/1990 Sines ..... A63B 51/00 473/540
5,257,781 A * 11/1993 Sines ..... A63B 49/022 473/539
5,435,550 A * 7/1995 You ..... A63B 49/022 473/542
5,879,248 A * 3/1999 Marsico ..... A63B 49/025 473/534
5,944,624 A * 8/1999 Davis ..... A63B 49/028 473/522
6,440,015 B1 * 8/2002 Chang ..... A63B 49/022 473/539
7,217,203 B2 * 5/2007 Takeuchi ..... A63B 49/022 473/539

(Continued)

*Primary Examiner* — Joseph B Baldori
(74) *Attorney, Agent, or Firm* — INVENZA CAPITAL GROUP PLC

(57) ABSTRACT

A pad structure applied to a damping device and a racket frame or a racket frame with a through hole and a string includes a first slider having an end corresponding to the bottom of the damping device or the string or the racket frame and another end having a primary junction, a second slider installed to the other end of the first slider, and an end of the second slider having a secondary junction opposite to the primary junction, and the other end of the second slider being corresponding to the racket frame or the string; the first or second slider being in a trapezium shape and includes a lower level portion at a lower triangle of the first slider or a substrate portion at a lower triangle of the second slider.

10 Claims, 14 Drawing Sheets

(56) References Cited

U.S. PATENT DOCUMENTS

| | | | | |
|---|---|---|---|---|
| 8,888,616 | B2 * | 11/2014 | Kitchen | A63B 60/42 473/540 |
| 10,004,950 | B1 * | 6/2018 | Kapheim | A63B 49/028 |
| 10,406,406 | B2 * | 9/2019 | Kawabata | A63B 49/022 |
| 11,161,017 | B1 * | 11/2021 | Varan | A63B 49/028 |
| 11,617,932 | B2 * | 4/2023 | Chen | A63B 60/54 473/520 |
| 2006/0166767 | A1 * | 7/2006 | Yanahara | A63B 51/12 473/553 |
| 2023/0021604 | A1 * | 1/2023 | Chen | A63B 49/022 |
| 2023/0099809 | A1 * | 3/2023 | Chen | A63B 60/54 473/524 |

* cited by examiner

PAD STRUCTURE

BACKGROUND

Technical Field

The present disclosure relates to a device and more particularly to a pad structure that can filter out specific amplitude of a racket frame and a string or enhance or comply with specific pound of force.

Description of Related Art

Various traditional rackets generally come with vertical and horizontal (X-axis and Y-axis) strings on their racket frame. The racket frames are mainly provided with substantially symmetrical vertical and horizontal threading holes around them, and the single nails are installed in the threading holes and the string is passed into the single nail and woven into a racket surface with a certain pound of force, and the racket frame with string constitutes the racket provided for a very intense hitting sport such as tennis, badminton, racket ball, etc. In order to catch the ball falling into the sweet spot of the racket, the athlete holding the racket not only needs to move quickly, but also needs to have continuity. More importantly, the string of the racket frame and the ball produce shock waves at the moment of hitting, which will make the athlete's wrist and arm feel numb, wherein the anti-shock force is proportional to the pound of force (i.e. tightness) of the string tension, and the higher the pound of force, the greater the anti-vibration force, and the anti-vibration force will be transmitted along the racket to the wrist or arm which may easily cause sports injuries such as tennis elbow caused by backhand swings or golf elbow symptom caused by forehand swings. Since the conventional racket is woven with the string of the racket frame, although related manufacturers have developed devices to reduce vibration, the shock generated by the slap of the racket surface and the ball and string can be absorbed and buffered and completely transmitted to the wrist and arm to allow the racket to be held stably, and adjust the weight around the racket frame according to the athlete's needs, yet the specific amplitudes of the racket frame and the string are fixed and cannot be fine-tuned and filtered out to enhance or comply with a certain pound force. Obviously, the related art still has room for improvement and requires breakthroughs.

Therefore, how to solve the problem is worthy of consideration by related manufacturers and those having ordinary skill in the art.

SUMMARY

In view of the drawbacks of the related art, it is a primary objective of the present disclosure to provide a pad structure that uses a first slider or a second slider or the first slider and the second slider having a primary junction and a secondary junction respectively, or having a lower wall block, a guide bump and a wall block to overcome the drawbacks of the related art.

A secondary objective of this disclosure is to provide a pad structure that uses a first slider and a second slider to provide a string suspension or form a guide angle by the primary junction and the secondary junction, so that inclined planes can be used to move and dislocate relative to each other and to shift the string from the center to correct the specific amplitude.

A further objective of this disclosure is to provide a pad structure that can effectively improve the convenience of adjustment and use and filter out specific amplitude of the racket frame and string and enhance or comply with the specific pound of force.

The problem of the related art to be solved by this disclosure is the vibration and shock of the commonly used racket frame with a string. Although related manufacturers have developed devices to reduce the vibration and shock of the anti-vibration force generated by striking the racket surface composed of the ball and the string can be absorbed and buffered and transmitted to the athlete's wrist and arm completely to allow the racket to be held stably, and adjust the weight around the racket frame according to the athlete's needs, yet the specific amplitude of the string is fixed, and cannot be fine-tuned to filter out specific amplitudes of the racket frame and the string, and cannot enhance and comply with a specific pound of force. The related art still has room for improvements.

To overcome the aforementioned problem and achieve the aforementioned objectives, this disclosure provides a pad structure applied to a damping device and a racket frame or a racket frame with a through hole and a string, and the through hole is provided with a single nail for passing a string, and the pad structure comprises:

at least one first slider, having an end configured to be corresponsive to the bottom of the damping device or the string or the racket frame and another end with a primary junction; and at least one second slider, installed at the other end of the first slider and having an end with a secondary junction and opposite to the primary junction of the first slider, and the other end configured to be corresponsive to the racket frame or the string;

wherein, the first slider and the second slider provides a suspension of the string or the primary junction and the secondary junction form a guide angle for filtering out specific amplitude and enhance or comply with a specific pound of force.

In this disclosure, the first slider and the second slider are in a shape freely selected from the group consisting of a rectangular shape, a square shape and a triangular shape or a combination thereof, and the primary junction of the first slider and the secondary junction of the second slider opposite to each other are substantially horizontal to the racket frame.

In this disclosure, the first slider and the second slider are in a shape freely selected from the group consisting of a triangular shape and a trapezium shape, or a combination of the above, and the primary junction of the first slider and the secondary junction of the second slider opposite to each other are tilted with an angle relative to the racket frame.

In this disclosure, the first slider or the second slider or an outer section of the first slider and the second slider is provided with a bore for passing the string and configured to be corresponsive to the through hole of the racket frame.

In this disclosure, the first slider or the second slider or an outer side of the first slider and the second slider is provided with a side recess and configured to be corresponsive the through hole of the racket frame and the string passing out from the through hole.

In this disclosure, the bore of the first slider and the bore of the second slider are in a shape including but not limited to the shape of a semicircular hole or a circular hole.

In this disclosure, the first slider or the second slider is in a trapezium shape and comprises a lower level portion disposed at a lower triangle of the first slider or a substrate portion disposed at a lower triangle of the second slider.

In this disclosure, the lower level portion is made of a hard material, and the substrate portion is made of a soft material or a hard material.

In this disclosure, the first slider and the second slider are in a triangular shape, and an end of the first slider is configured to be corresponsive to the racket frame, and the other end of the second slider is provided with two vertical wall blocks and a string slot engaging with the string In this disclosure, the other end of the primary junction at of the first slider is provided with two vertical lower wall blocks and has an embedding slot, and an end of the second slider is configured to be corresponsive to the secondary junction of the primary junction and provided with a guide bump perpendicular to the embedded slot and engaged with the embedding slot.

Although related manufacturers have developed devices to reduce vibration, the shock generated by the slap of the racket surface and the ball and string can be absorbed and buffered and completely transmitted to the wrist and arm to allow the racket to be held stably, and adjust the weight around the racket frame according to the athlete's needs, yet the amplitude is fixed and cannot be fine-tuned to filter out specific amplitude of the racket frame and the string, and cannot enhance or comply with the specific pound of force. Obviously, the related art still has room for improvement.

Compared with the related art, this disclosure adopts the first slider or the second slider or the first slider and the second slider having the primary junction and the secondary junction, or having the lower wall blocks, the guide bumps and the wall blocks, so that the inclined planes can be used to move and dislocate relative to each other and to shift the string from the center to correct the specific amplitude. This disclosure effectively improves the convenience of adjustment and use, filters out specific amplitude of the racket frame 4 and the string 5, and enhances or complies with the specific pound of force. This disclosure complies with the three patentability criteria, respectively: novelty, inventive step/non-obviousness and industrial applicability.

DESCRIPTION OF THE EMBODIMENTS

This disclosure will now be described in more detail with reference to the accompanying drawings that show various embodiments of this disclosure. It is intended that the embodiments and drawings disclosed herein are to be considered illustrative rather than restrictive, and also noteworthy that the drawings are not necessary drawn according to the real proportion and precise configuration and these attached drawings should not limit the scope of the patent of this disclosure in actual implementation.

Figure 3:
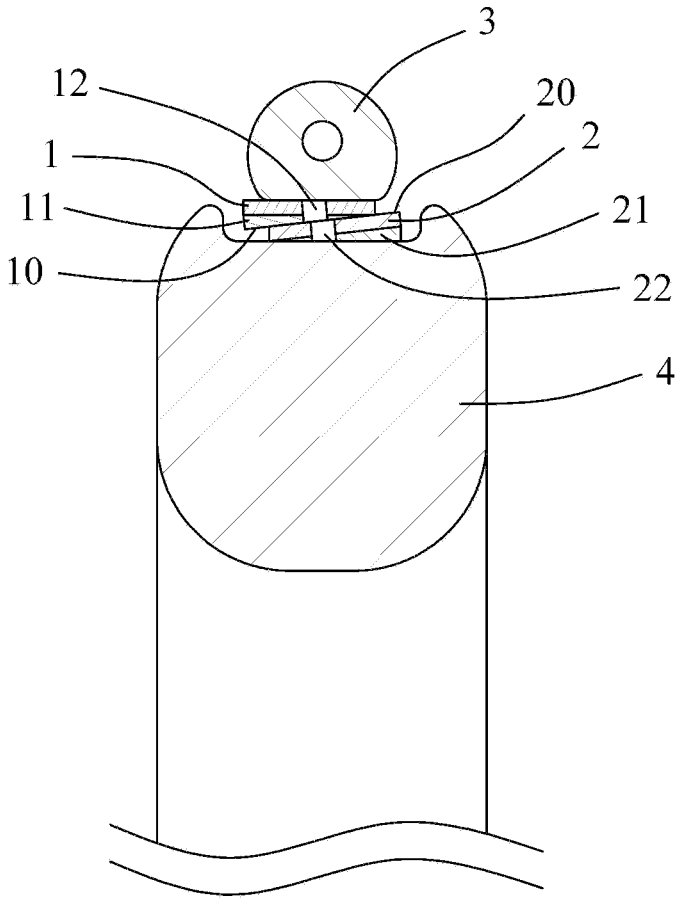
FIG. 3 is a cross-sectional view showing a first slider and a second slider in the shape of a trapezium in accordance with this disclosure.
Figure 4:
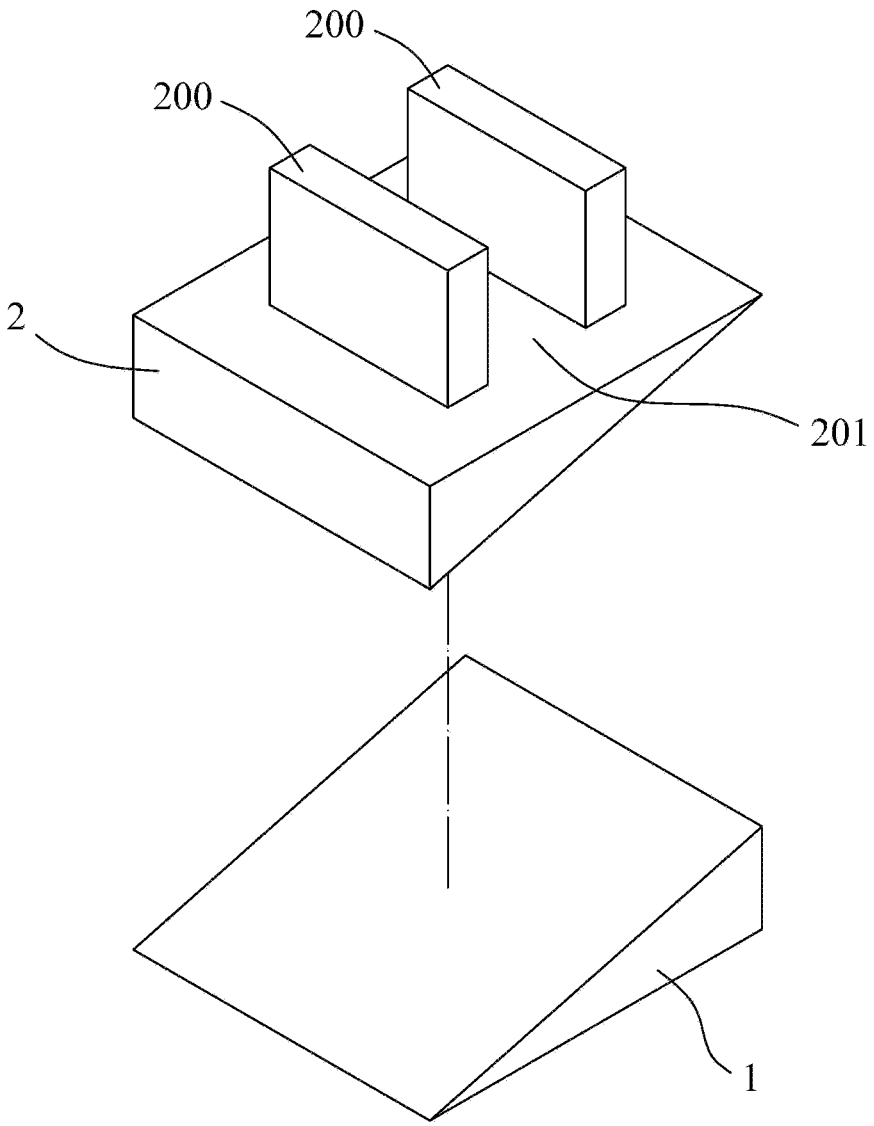
FIG. 4 is an exploded view showing a first slider and a second slider in the shape of a trapezium and the second slider having two wall blocks in accordance with this disclosure.
Figure 5:
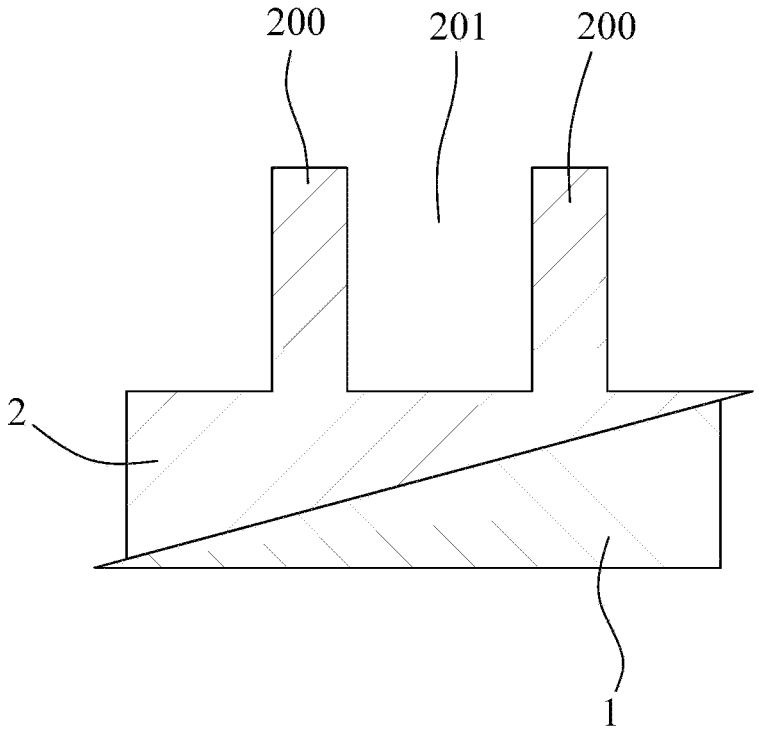
FIG. 5 is a cross-sectional view showing a first slider and a second slider in the shape of a trapezium and the second slider having two wall blocks in accordance with this disclosure.
Figure 6:
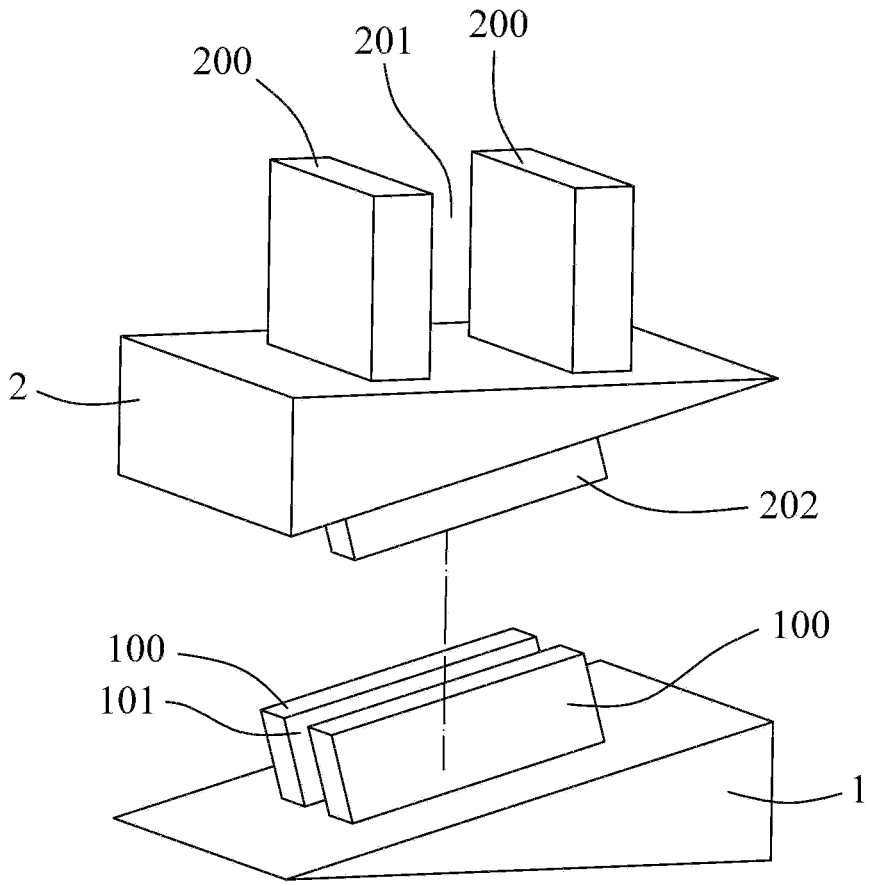
FIG. 6 is an exploded view showing the first slider of FIG. 4 having two lower wall blocks and the second slider having a guide bump in accordance with this disclosure.

With reference to FIGS. 1 to 14 for the exploded, perspective and cross-sectional views showing a first slider and a second slider in a trapezium shape, the exploded and perspective views showing a first slider and a second slider in the shape of a trapezium and the second slider having two wall blocks, the exploded and cross-sectional views showing the first slider and the second slider in a triangular shape and the second slider having two wall blocks, the exploded and cross-sectional views showing the first slider of FIG. 4 having two lower wall blocks and the second slider having a guide bump, the perspective view showing the racket frame of FIG. 6 and having a string engaged with a bore, the perspective view showing the racket frame of FIG. 6 and having a string engaged with a side recess, and the first to fifth side views showing the first slider and the second slider in a combination of various different shapes in accordance with this disclosure respectively, a pad structure of a preferred embodiment is applied to a damping device 3 and a racket frame 4 or a racket frame 4 having a through hole 41 and a string 5, and the through hole 41 of the racket frame 4 has a single nail 42 provided for passing the string 5, and the pad structure includes at least one first slider 1 and at least one second slider 2.

The at least one first slider 1 has an end configured to be corresponsive to the bottom of the damping device 3 or the string 5 or the racket frame 4, and the other end having a primary junction 10 (as shown in FIGS. 1 to 3 and 10 to 14.)

The at least one second slider 2 is installed at the other end of the first slider 1, and an end of the second slider 2 has a secondary junction 20 disposed opposite to the primary junction 10 of the first slider 1, and the other end of the second slider 2 is configured to be corresponsive to the racket frame 4 or the string 5 (as shown in FIGS. 1 to 3 and 10 to 14.) The first slider 1 and the second slider 2 are provided for the suspension of the string 5, or the primary junction 10 and the secondary junction 20 form a guide angle for filtering out specific amplitude and enhance or comply with the specific pound of force.

Figure 1:
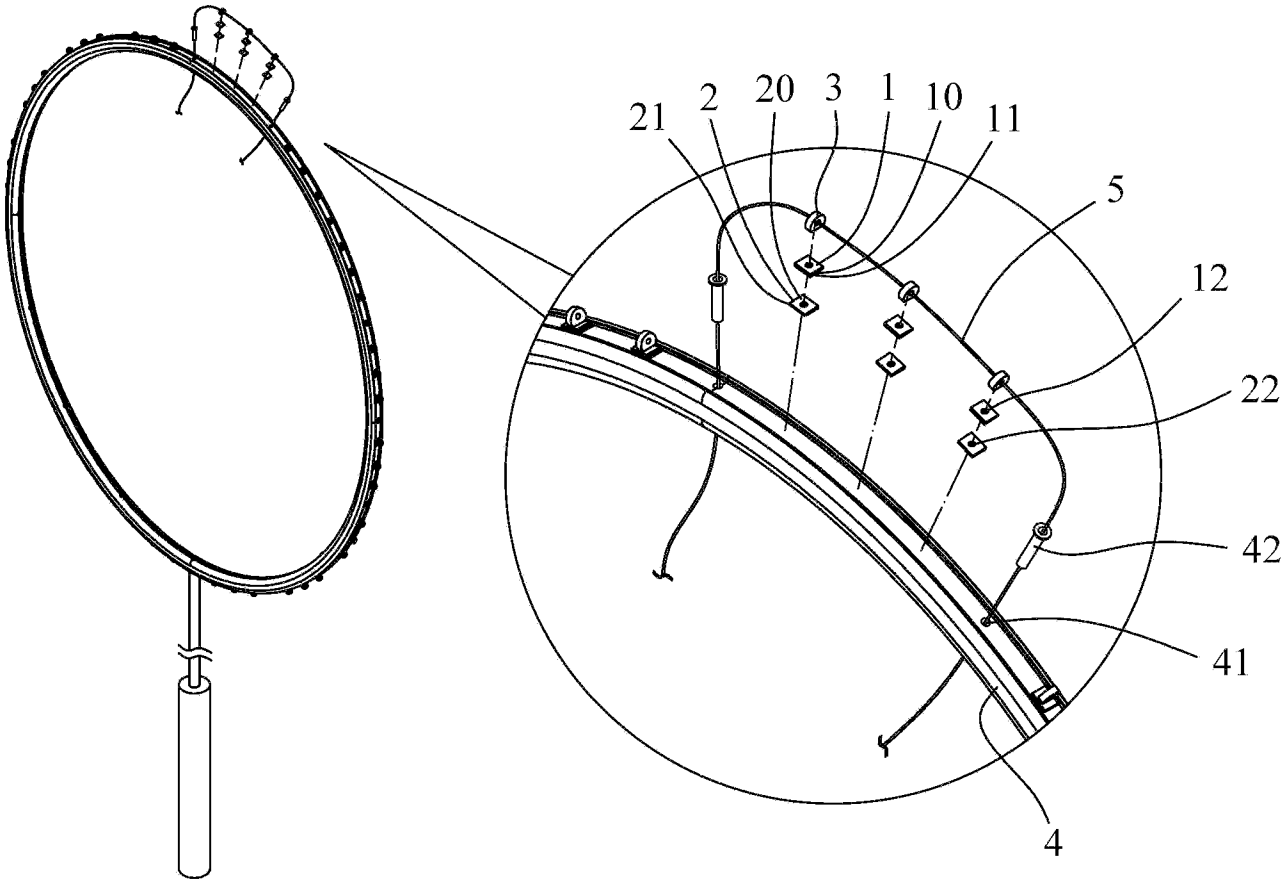
FIG. 1 is an exploded view showing a first slider and a second slider in the shape of a trapezium in accordance with this disclosure.
Figure 2:
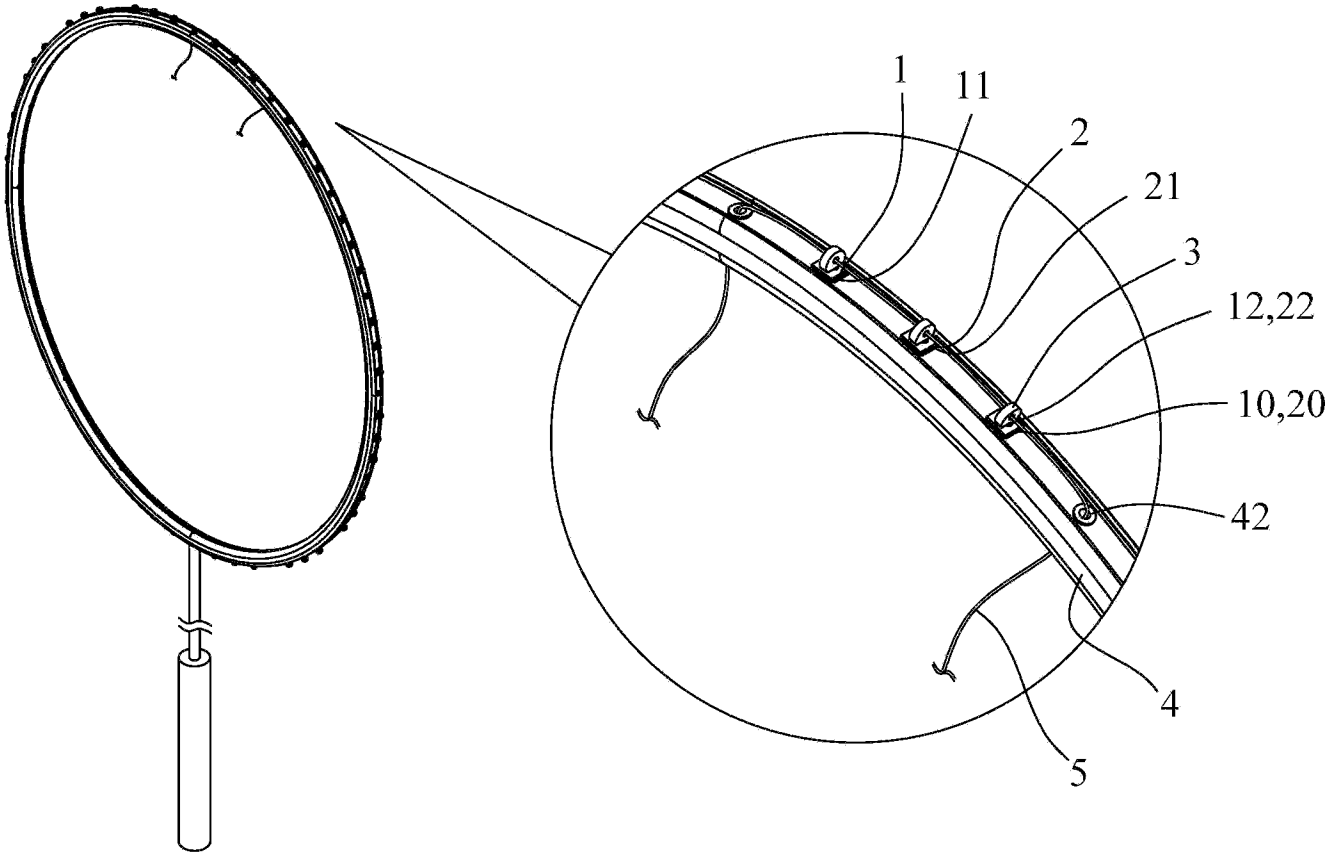
FIG. 2 is a perspective view showing a first slider and a second slider in the shape of a trapezium in accordance with this disclosure.
Figure 9:
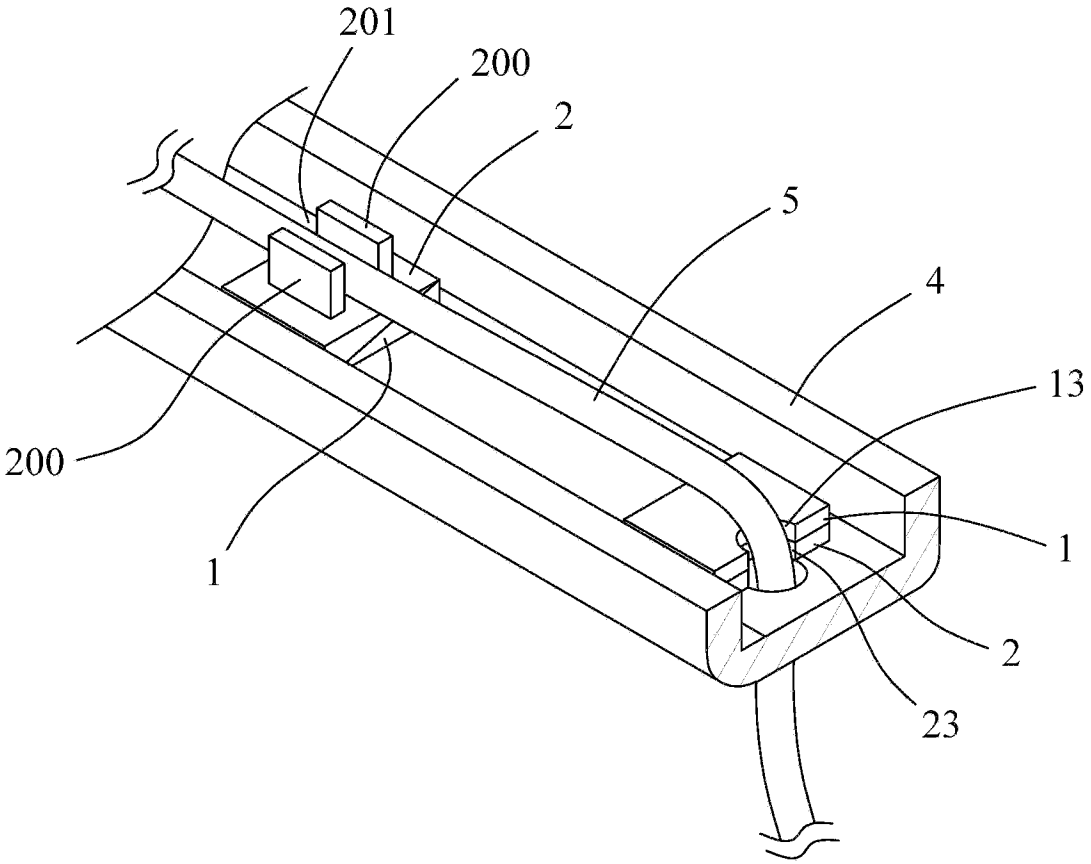
FIG. 9 is a perspective view showing the racket frame of FIG. 6 and having a string engaged with a side recess in accordance with this disclosure.
Figure 10:
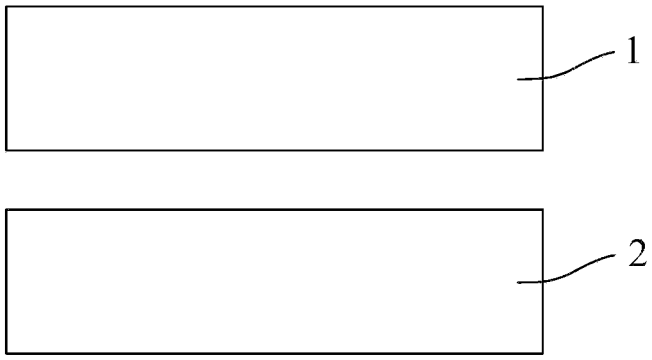
FIGS. 10 to 14 are the first to fifth side views showing a combination of different shapes of the first slider and the second slider of this disclosure respectively.
Figure 11:
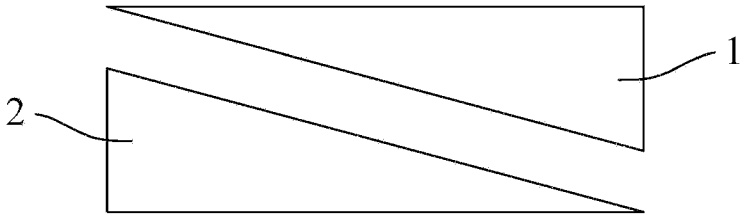
Figure 12:
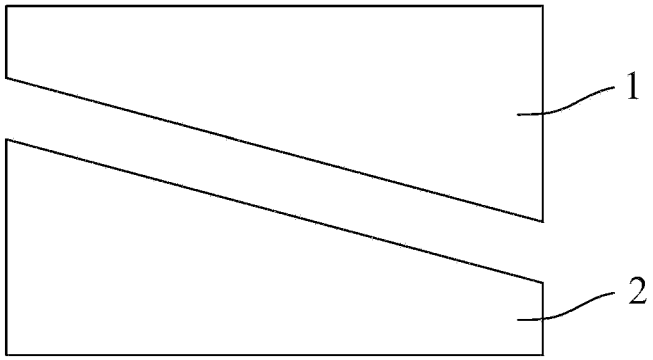
Figure 13:
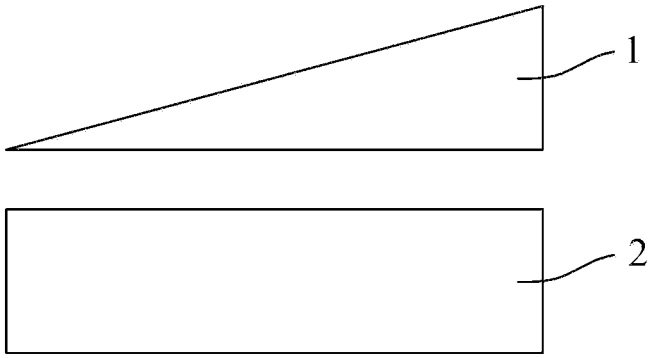
Figure 14:
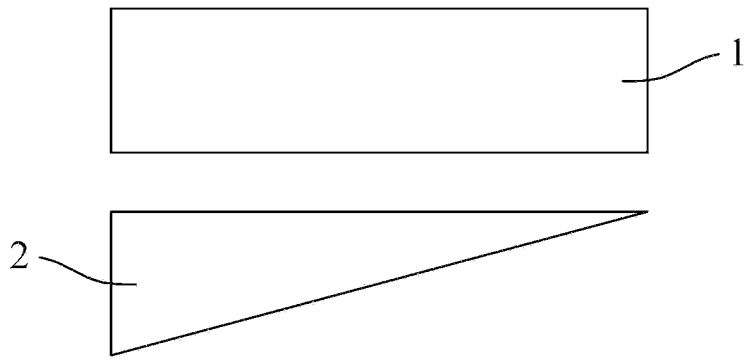

In this disclosure, the first slider 1 and the second slider 2 are in a shape freely selected from the group consisting of a rectangular shape, a square shape, a triangular shape, and any combination of the above, the primary junction 10 of the first slider 1 and the secondary junction 20 of the second slider 2 opposite to each other are substantially horizontal to the racket frame 4 (as shown in FIGS. 10, 13 and 14); the first slider 1 and the second slider 2 are in a shape freely selected from the group consisting of a triangular shape, a trapezium or any combination of the above, and the primary junction 10 of the first slider 1 and the secondary junction 20 of the second slider 2 opposite to each other are tilted with an angle relative to the racket frame 4 (as shown in FIGS. 1 to 9 and 11 to 12); the first slider 1 or the second slider 2 in the trapezium shape includes a lower level portion 11 disposed at a lower triangle of the first slider 1 or a substrate portion 21 disposed at a lower triangle of the second slider 2 (as shown in FIGS. 1 to 3), and the lower level portion 11 is made of a hard material, and the substrate portion 21 is made of a soft material or a hard material.

the first slider 1 or the second slider 2 or the first slider 1 and the outer section of the second slider 2 have a bore 12, 22 separately provided for passing the string 5 and configured to be corresponsive to the through hole 41 of the racket frame 4, and the bore 12 of the first slider 1 and the bore 22 of the second slider 2 are in a shape including but not limited to the shape of a semicircular hole or a circular hole (as shown in FIGS. 1 to 3 and 8); and the first slider 1 or the second slider 2 or the outer edges of the first slider 1 and the second slider 2 of this disclosure are provided with a side recess 13, 23 which is configured to be corresponsive to the through hole 41 of the racket frame 4 and the string 5 passing out from the through hole 41 (as shown in FIG. 9).

Figure 7:
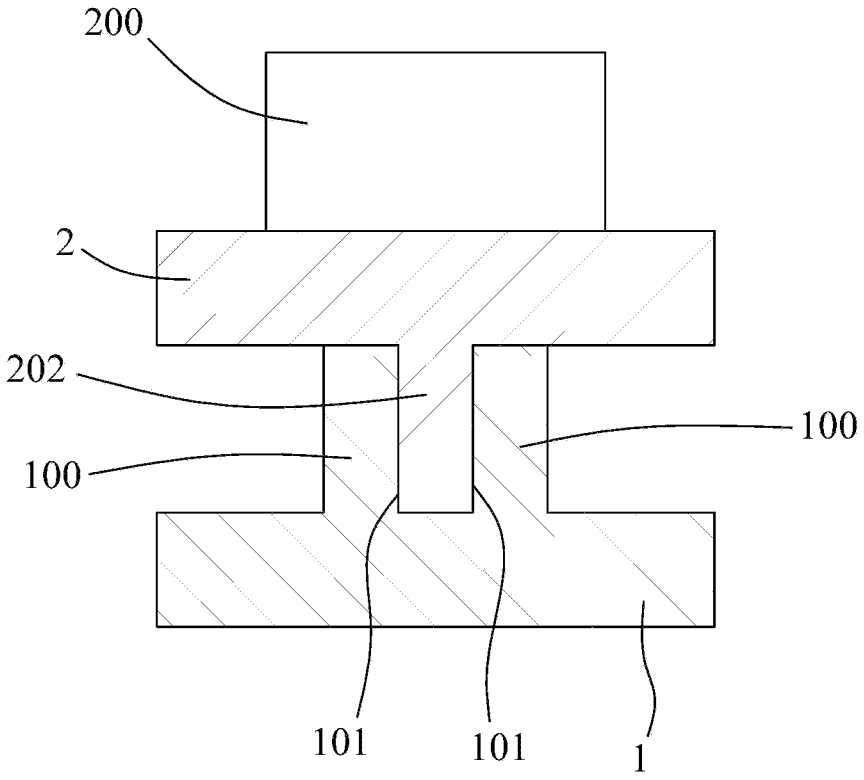
FIG. 7 is a cross-sectional view showing the first slider of FIG. 4 having two lower wall blocks and the second slider having a guide bump in accordance with this disclosure.
Figure 8:
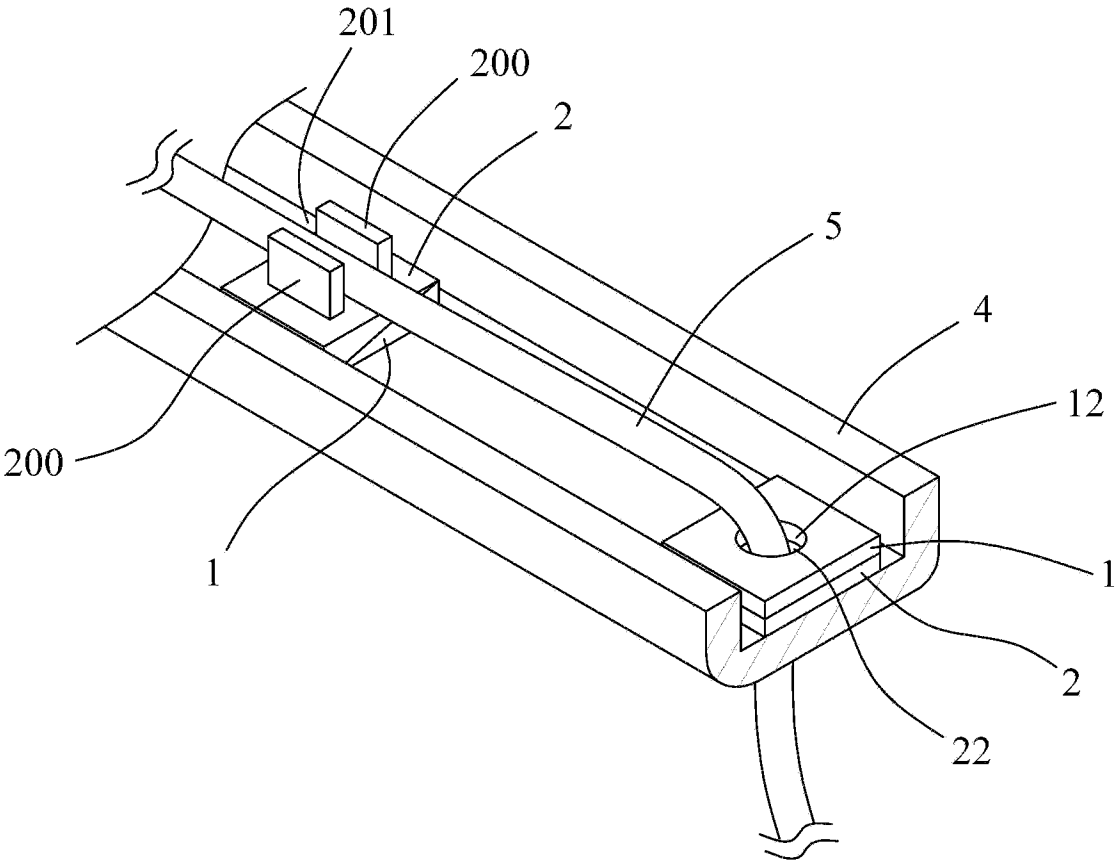
FIG. 8 is a perspective view showing the racket frame of FIG. 6 and having a string engaged with a bore in accordance with this disclosure.

The first slider 1 and the second slider 2 are in a triangular shape, and the first slider 1 has an end corresponding to the racket frame 4 and another end having two vertical wall blocks 200 and a string slot 201 for sheathing the string 5 (as shown in FIGS. 4 and 5). In addition, the primary junction 10 at the other end of the first slider 1 has two vertical lower wall blocks 100 and an embedding slot 101, and an end of the second slider 2 is configured to be corresponsive to the secondary junction 20 of the primary junction 10 and provided with a guide bump 202 perpendicular the embedding slot 101 and embedded into the embedding slot 101 (as shown in FIGS. 6 and 7).

This disclosure uses the first slider 1 or the second slider 2 or the first slider 1 and the second slider 2 having the primary junction 10 and the secondary junction 20 respectively, or having the lower wall block 100 and the guide bump 202 and the wall block 200 to achieve the effect of this disclosure and also uses the first slider 1 and the second slider 2 to provide the suspension of the string 5, or the primary junction 10 and the secondary junction 20 form a guide angle, so that the inclined planes can be used to move and dislocate relative to each other and to shift the string from the center to correct the specific amplitude. This disclosure effectively improves the convenience of adjustment and use, filters out specific amplitude of the racket frame 4 and the string 5, and enhances or complies with the specific pound of force. This disclosure complies with the three patentability criteria, respectively: novelty, inventive step/non-obviousness and industrial applicability.

What is claimed is:

1. A pad structure for use with a racket frame and a damping device, the racket frame having a through hole and a string, the through hole being provided with a grommet for passing the string, the pad structure comprising:

at least one first slider having a first surface and a second surface located opposite the first surface, the first surface being a sliding surface and the second surface being a horizontal surface; and at least one second slider having a first surface and a second surface located opposite the first surface, the first surface is a sliding surface and the second surface is a horizontal surface, the sliding surface of the at least one first slider corresponding with the sliding surface of the at least one second slider, the at least one first slider and the at least one second slider are located between the racket frame and the damping device;

wherein the sliding surface of the at least one first slider and the sliding surface of the at least one second slider are slidably engaged and are configured to generate relative dislocation movement in response to vibration of the string, thereby filtering out specific amplitude of vibration.

2. The pad structure according to claim 1, wherein the at least one first slider and the at least one second slider have a shape selected from the group consisting of a rectangular shape, a square shape and a triangular shape or a combination thereof, and the sliding surface of the at least one first slider and the sliding surface of the at least one second slider are horizontal to the racket frame.

3. The pad structure according to claim 1, wherein the at least one first slider and the at least one second slider have a shape selected from the group consisting of a triangular shape and a trapezium shape, or a combination thereof, and the sliding surface of the at least one first slider and the sliding surface of the at least one second slider are tilted with an angle relative to the racket frame.

4. The pad structure according to claim 3, wherein the at least one first slider or the at least one second slider is in a trapezium shape and comprises a lower level portion disposed at a lower triangle of the first slider, the lower level portion is made of a hard material.

5. The pad structure according to claim 3, wherein the at least one first slider or the at least one second slider is in a trapezium shape and comprises a substrate portion disposed at a lower triangle of the second slider, the substrate portion is made of a soft material or a hard material.

6. The pad structure according to claim 3, wherein the at least one first slider and the at least one second slider are in a triangular shape, and the horizontal surface of the at least one first slider is located adjacent to the racket frame, and the horizontal surface of the at least one second slider has two vertical wall blocks and a string slot engaging with the string.

7. The pad structure according to claim 1, wherein the at least one first slider or an outer section of the first slider is provided with a first bore and the at least one second slider or an outer section of the at least one second slider is provided with a second bore for passing the string and corresponding with the through hole of the racket frame.

8. The pad structure according to claim 7, wherein the first bore of the at least one first slider and the second bore of the at least one second slider are in a shape including but not limited to the shape of a semicircular hole or a circular hole.

9. The pad structure according to claim 1, wherein the at least one first slider or an outer side of the at least one first slider and the at least one second slider or an outer side of the at least one second slider is provided with a side recess corresponding with the through hole of the racket frame and the string passing out from the through hole.

10. A pad structure for use with a racket frame and a damping device, the racket frame having a through hole and a string, the through hole being provided with a grommet for passing the string, the pad structure comprising:

at least one first slider having a first surface and a second surface located opposite the first surface, the first surface being a sliding surface and the second surface being a horizontal surface; and at least one second slider having a first surface and a second surface located opposite the first surface, the first surface is a sliding surface and the second surface is a horizontal surface, the sliding surface of the at least one first slider corresponding with the sliding surface of the at least one second slider, the at least one first slider and the at least one second slider are located between the racket frame and the damping device;

wherein the sliding surface of the at least one first slider and the sliding surface of the at least one second slider are slidably engaged and are configured to generate relative dislocation movement in response to vibration of the string, thereby filtering out specific amplitude of vibration;

wherein the at least one first slider and the at least one second slider have a shape selected from the group consisting of a triangular shape and a trapezium shape, or a combination thereof, and the sliding surface of the at least one first slider and the sliding surface of the at least one second slider are tilted with an angle relative to the racket frame;

wherein the at least one first slider and the at least one second slider are in a triangular shape, and the horizontal surface of the at least one first slider is located adjacent to the racket frame, and the horizontal surface of the at least one second slider has two vertical wall blocks and a string slot engaging with the string;

wherein the sliding surface of the at least one first slider has two vertical lower wall blocks and an embedding slot, and the sliding surface of the at least one second slider has a guide bump inserted in the embedding slot.

* * * * *